US008371153B2

(12) United States Patent
Penton et al.

(10) Patent No.: US 8,371,153 B2
(45) Date of Patent: Feb. 12, 2013

(54) APPARATUS AND METHOD FOR PURGING GASES RELEASED FROM A HEAT EXCHANGER

(75) Inventors: John D. Penton, Pasadena, TX (US); Ronald W. Hill, Katy, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 247 days.

(21) Appl. No.: 12/683,507

(22) Filed: Jan. 7, 2010

(65) Prior Publication Data

US 2011/0162830 A1 Jul. 7, 2011

(51) Int. Cl.
*G01M 3/18* (2006.01)

(52) U.S. Cl. ..... 73/40.7; 165/11.1; 165/278; 165/281

(58) Field of Classification Search ..... 73/40.7; 165/11.1, 278, 281
See application file for complete search history.

(56) References Cited

U.S. PATENT DOCUMENTS

| | | | | |
|---|---|---|---|---|
| 3,884,511 | A | 5/1975 | Hermanson | |
| 4,139,220 | A | 2/1979 | Faccou et al. | |
| 4,384,736 | A | 5/1983 | Hartung | |
| 4,429,905 | A | 2/1984 | Valentine | |
| 4,741,561 | A | 5/1988 | Morita et al. | |
| 5,117,640 | A | 6/1992 | Ginfrida, Jr. | |
| 5,131,263 | A * | 7/1992 | Handke et al. | 73/40.7 |
| 5,133,577 | A | 7/1992 | Schultze et al. | |
| 5,411,298 | A | 5/1995 | Pollack | |
| 5,531,593 | A | 7/1996 | Klobucar | |
| 5,553,483 | A * | 9/1996 | Armentrout et al. | 73/40 |
| 5,707,229 | A | 1/1998 | Klobucar | |
| 5,730,945 | A | 3/1998 | Klobucar | |
| 5,760,292 | A | 6/1998 | Jostein | |
| 5,788,288 | A | 8/1998 | Jostein | |
| 6,308,556 | B1 * | 10/2001 | Sagi et al. | 73/40 |
| 6,314,794 | B1 * | 11/2001 | Seigeot | 73/40.7 |
| 6,533,334 | B1 | 3/2003 | Bonn | |
| 6,581,976 | B1 | 6/2003 | Pollack et al. | |
| 7,118,137 | B2 | 10/2006 | Deremiah | |
| 2003/0056535 | A1 | 3/2003 | Beam | |

OTHER PUBLICATIONS

PCT Notification of Transmittal of the International Search Report and the Written Opinion of the International Searching Authority, or the Declaration; Jun. 27, 2011 (8 pages).

* cited by examiner

*Primary Examiner* — Hezron E Williams
*Assistant Examiner* — Paul West
(74) *Attorney, Agent, or Firm* — Melissa Patangia; Nicholas F. Gallo

(57) ABSTRACT

An apparatus and method for purging gases released from a heat exchanger are provided. The apparatus includes an enclosure that defines an interior space and is configured to receive at least a portion of the heat exchanger. A gas source is configured to deliver an inert gas to the interior space of the enclosure at a pressure higher than an ambient pressure outside the gas source and the enclosure. The enclosure is adapted to maintain a positive pressure difference between the interior space and the ambient pressure. A detector is configured to detect a leak of a gas from the heat exchanger into the interior space of the enclosure. A pressure relief device configured to release gas from the interior space of the enclosure if the pressure in the interior space exceeds a predetermined level.

13 Claims, 6 Drawing Sheets

APPARATUS AND METHOD FOR PURGING GASES RELEASED FROM A HEAT EXCHANGER

BACKGROUND OF THE INVENTION

1. Field of the Invention

This invention relates to the management of gases released from a heat exchanger and, more particularly, to an apparatus and method for purging such gases that may be released.

2. Description of Related Art

In a heat exchanger, thermal energy is transferred from a first flow of hot fluid to a second flow of cooler fluid. For example, in one typical air-cooled heat exchanger used to cool a hot gas, the flow of the hot gas is directed through a number of parallel tubes. At a first header at a first end of the heat exchanger, each of a first plurality of the tubes defines an inlet, and each of a second plurality of the tubes defines an outlet. At the opposite end of the heat exchanger, the tubes are joined, e.g., by a second, or return, header. The return header can be a device that collects the gas flowing through the first plurality of tubes, with some mixing of the gas at the second end, and directs the gas through the second plurality of tubes. The hot gas flows in a generally U-shaped path through the tubes, i.e., the gas enters the inlet of a first tube at the first header, flows linearly through the entire length of the first tube, reverses direction at the return header, and then flows linearly through a second tube and out through the outlet at the first header. The tubes can be enclosed in a housing, such as a tubesheet or shell, through which a cool gas, such as air, can flow, typically in a direction that is transverse to the direction of the tubes. Thermal energy is transferred between the gases, e.g., from a hot gas flowing through the tubes to the cool air flowing through the housing.

Each tube can be a generally linear component that is formed separately, and the headers can provide a connection to the ends of the tubes. Each header can provide access ports so that the tubes can be accessed without disassembly of the entire heat exchanger. For example, each header can define a number of small holes, each being aligned with the end of a respective tube so that tube can be accessed through its respective hole in the header, e.g., to check or repair the tubes. The holes can be threaded, and a corresponding threaded plug can be secured in each hole to seal the hole during operation so that gas in the header is contained.

It may undesirable for the fluid passing through the tubes to leak or otherwise be released therefrom to the environment, and/or it may be undesirable for the fluid to exist in concentrated form outside the heat exchanger. For example, in the case of a flammable fluid such as hydrogen, it may be desirable to either contain the fluid entirely within the heat exchanger or, in the event of a small leak, to prevent the leaked fluid from collecting in concentrated form outside the heat exchanger. The possibility of such leaks can be reduced by alternate designs. For example, the plugs can be eliminated altogether or welded in place. However, such techniques generally make maintenance and inspection more difficult.

Thus, there exists a continued need for an improved apparatus and method for managing the possibility of such leaks from heat exchangers. The apparatus and method should be compatible with heat exchangers that have exposed headers or other components that present increased risk of leakage.

SUMMARY OF THE INVENTION

The embodiments of the present invention generally provide an apparatus and method for purging gases released from a heat exchanger. The apparatus and method can be used with various types of heat exchangers, e.g., heat exchangers with headers or other components subject to increased risk of leaking or other release. In the event of a leak from the heat exchanger, the apparatus can contain the leaked gas, dilute the leaked gas with an inert gas, and/or detect the leaked gas so that an appropriate corrective action can be taken in response to reduce any risk posed by the leak.

According to one embodiment of the present invention, the apparatus includes an enclosure that defines an interior space and is configured to receive at least a portion of the heat exchanger. A gas source, such as a tank of nitrogen gas, is configured to deliver an inert gas to the interior space of the enclosure at a pressure higher than an ambient pressure outside the gas source and the enclosure. The enclosure is adapted to maintain a positive pressure difference between the interior space and the ambient pressure. One or more detectors can be configured to detect a leak or other release of a gas from the heat exchanger into the interior space of the enclosure. A pressure relief device is configured to release gas from the interior space of the enclosure if the pressure in the interior space exceeds a predetermined level. The enclosure can also be configured to discharge inert gas from the interior space to the outside of the enclosure while maintaining the positive pressure difference so that the interior space is swept by the inert gas.

For example, the apparatus can include a heat exchanger that is configured to receive a flow of a first gas and a flow of a second gas and transfer thermal energy between the first and second gas. The heat exchanger can include a plurality of tubes for receiving the flow of the first gas and a header for connecting ends of the tubes, with the header being located at least partially in the interior space of the enclosure so that any gas leaked from the header is received in the enclosure and diluted by the inert gas therein. The header can define a threaded connection of components that seals the enclosure, e.g., a threaded connection between each of a plurality of threaded plugs and respective holes in the header that receive the plugs.

In one embodiment, the enclosure includes at least one side that defines an aperture for receiving an end of the heat exchanger and forming a hermetic seal with the heat exchanger so that the enclosure and the heat exchanger together define and seal the interior space. For example, the enclosure can include a first side that extends continuously around a perimeter of the heat exchanger, and the enclosure can include an access panel. The access panel can be removably connected to the first side by one or more fasteners so that the access panel can be removed from the side to allow access to the heat exchanger within the interior space.

A regulator can be configured to regulate the flow rate and/or the pressure of the inert gas provided from the gas source to the interior space of the enclosure to maintain the positive pressure difference.

A method according to one embodiment of the present invention includes providing an enclosure that defines an interior space and receives at least a portion of the heat exchanger in the interior space. A flow of inert gas, such as nitrogen, is delivered to the interior space of the enclosure at a pressure higher than an ambient pressure outside the enclosure and a positive pressure difference is maintained between the interior space and the ambient pressure. A leak of a gas from the heat exchanger into the interior space of the enclosure can be detected, and gas from the interior space of the enclosure can be released when the pressure in the interior space exceeds a predetermined level.

For example, the heat exchanger can receive a flow of a first gas through a plurality of tubes connected by a header of the heat exchanger. A flow of a second gas can also be received by the heat exchanger, and thermal energy can be transferred between the first and second gas. In some cases, one or more threaded connections can be provided to seal the header, and each threaded connection can be disposed in the enclosure. A leak of the first gas from the heat exchanger into the interior space of the enclosure can be detected, and the first gas leaked from the heat exchanger can be diluted with the inert gas in the enclosure.

In one embodiment, providing the enclosure includes providing at least one side that defines an aperture for receiving an end of the heat exchanger and forming a hermetic seal with the heat exchanger so that the enclosure and the heat exchanger together define and seal the interior space. For example, a first side and an access panel can be provided, the first side extending continuously around a perimeter of the heat exchanger, and the access panel being removably connected to the first side by one or more fasteners so that the access panel can be removed from the side to allow access to the heat exchanger within the interior space.

The flow rate and/or pressure of the inert gas that is provided to the interior space of the enclosure can be regulated to maintain the positive pressure difference. Further, the inert gas can be discharged from the interior space to the outside of the enclosure while maintaining the positive pressure difference so that the interior space is swept by the inert gas.

BRIEF DESCRIPTION OF THE DRAWINGS

Figure 1:
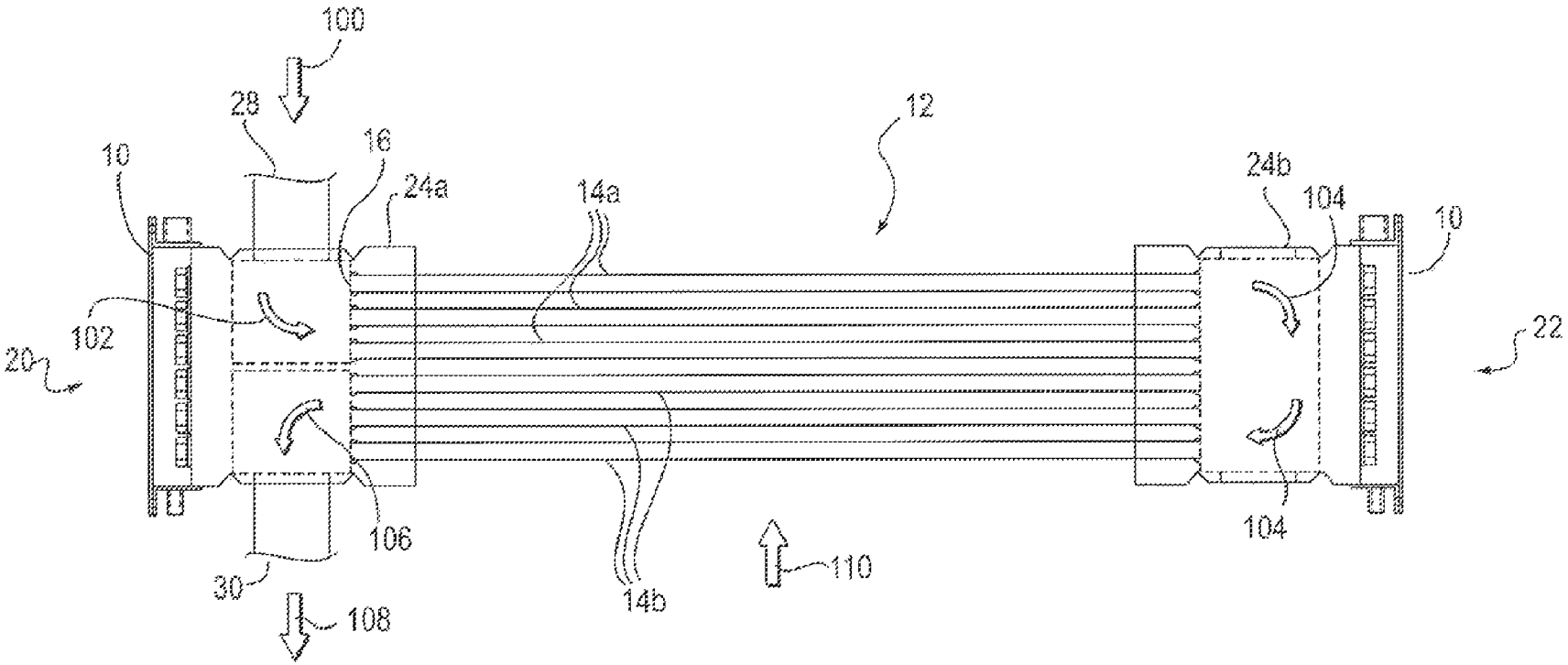
Figure 2:
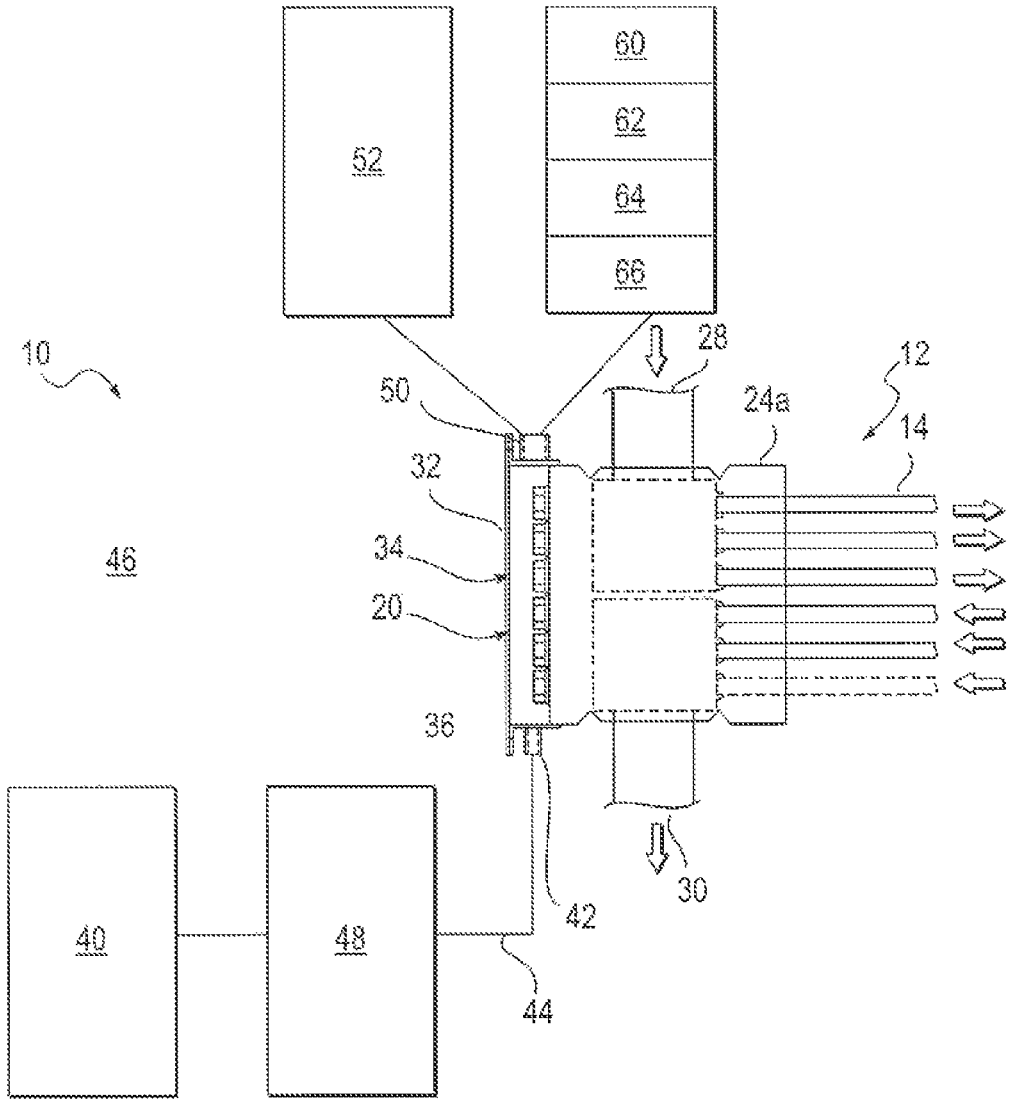
Figure 3:
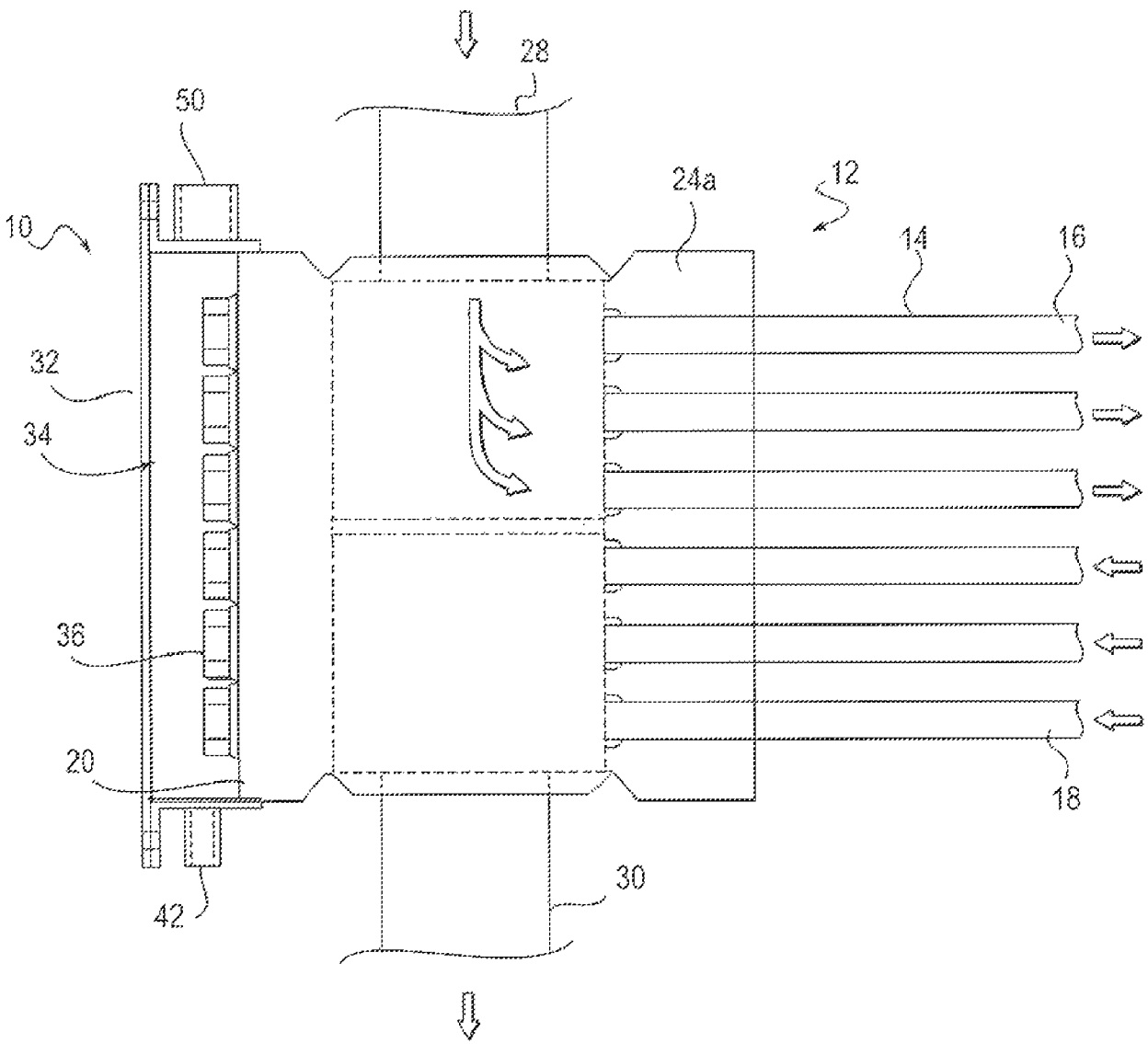
Figure 4:
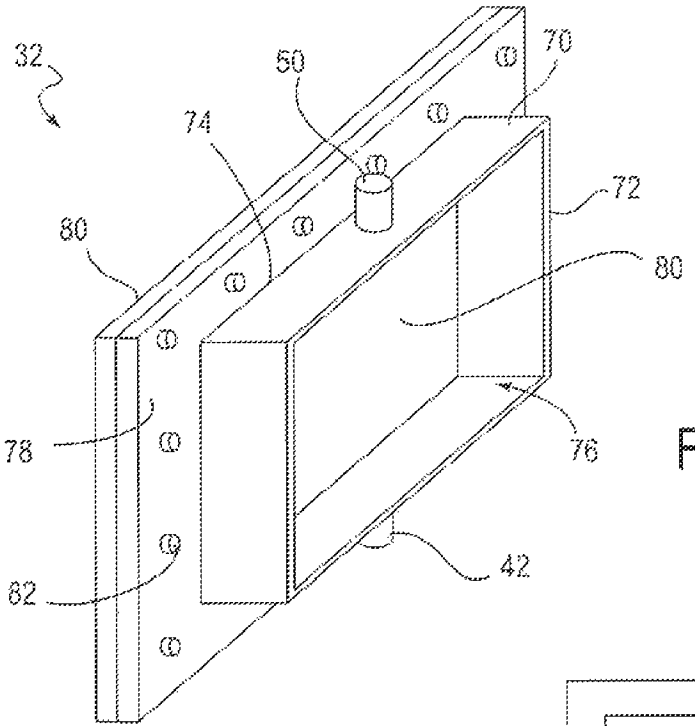
Figure 5:
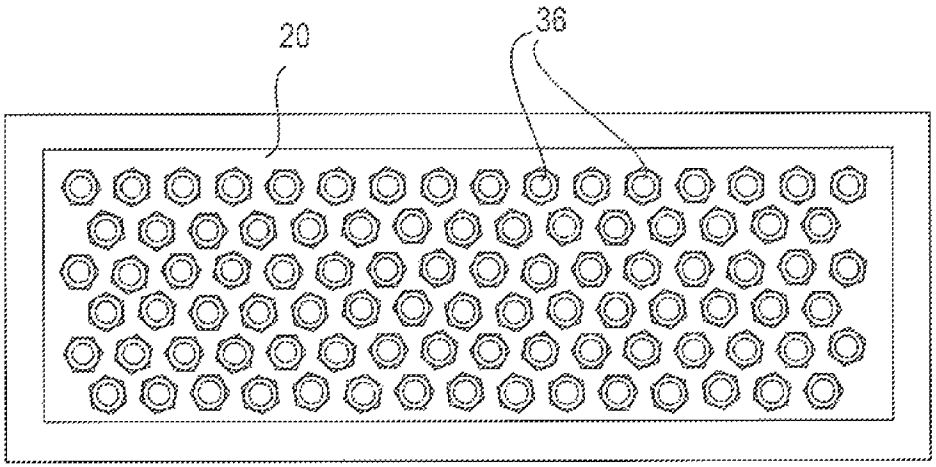
Figure 6:
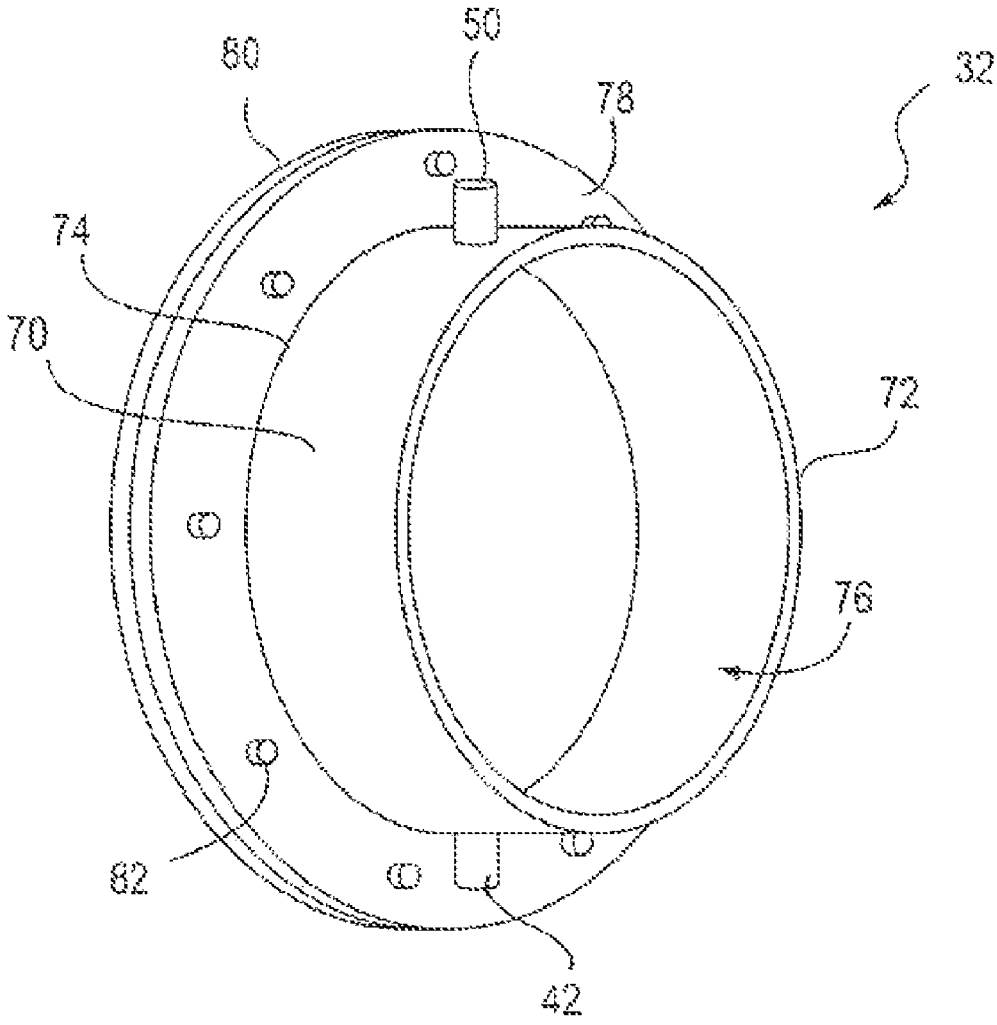
Figure 7:
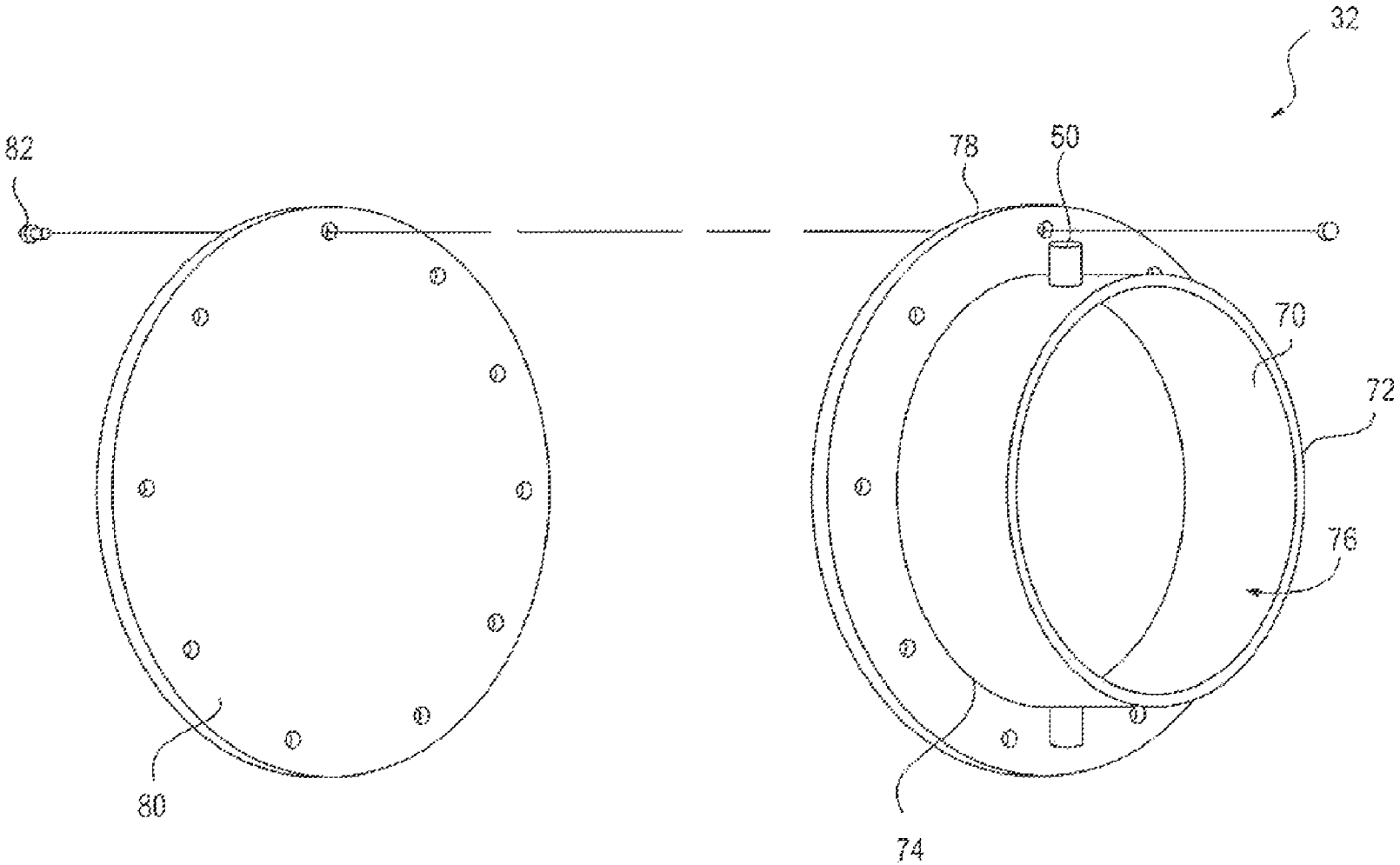

Having thus described the invention in general terms, reference will now be made to the accompanying drawings, which are not necessarily drawn to scale, and wherein:

FIG. 1 is a schematic view illustrating a system including two apparatuses for purging gases released from a heat exchanger according to one embodiment of the present invention;

FIG. 2 is a schematic view illustrating a portion of the system of FIG. 1, including one of the apparatuses shown in FIG. 1;

FIG. 3 is a enlarged view of a portion of the apparatus of FIG. 2;

FIG. 4 is a perspective view illustrating the apparatus of FIG. 3;

FIG. 5 is an end view illustrating the left end of the system of FIG. 1, shown with an access panel removed;

FIG. 6 is a perspective view illustrating an apparatus according to another embodiment of the present invention; and FIG. 7 is a perspective view illustrating the apparatus of FIG. 6 unassembled.

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Referring now to the drawings and, in particular, to FIG. 1, there is shown a system that includes two apparatuses 10 for purging gases released from a heat exchanger 12 according to one embodiment of the present invention. Each apparatus 10 can generally provide an inert gas to a space around at least a portion of the heat exchanger 12, typically a portion of the heat exchanger 12 from which leakage or other release is most likely. As shown in FIG. 1, multiple apparatuses 10 can be used for a single heat exchanger 12, or, in other cases, a single apparatus 10 can be used with one heat exchanger 12. Further, it is appreciated that the apparatus 10 can be used with various types of heat exchangers.

For example, as shown in FIGS. 1-3, the heat exchanger 12 can be an air-cooled or shell-and-tube device that is configured to receive and cool a flow of hot fluid, such as hydrogen gas. As illustrated in FIG. 1, the hot gas enters an inlet 28 of a first header 24*a* at a first end 20 of the heat exchanger 12 and into a first plurality of tubes 14*a* that define inlets 16 at the first manifold 24*a*. The hot gas flows through the tubes 14*a* to a second, opposite, second end 22 of the heat exchanger 12 and exits the tubes 14*a* into a second, or return, header 24*b* at the second end 22 of the heat exchanger 12. The return header 24*b* reverses the direction of the flow of the gas, and the gas then flows back through a second plurality of the tubes 14*b* (referred to collectively with tubes 14*a* by reference numeral 14) to the first header 24*a* and out of outlets 18 of the tubes 14*b* and out of an outlet 30 of the first manifold 24*a*. In this way, the gas enters at the first end 20 (in the direction indicated by arrow 100), enters the tubes 14*a* (direction indicated by arrow 102), flows from the first end 20 to the second end 22, reverses direction (direction indicated by arrows 104), flows back to the first end 20, exits the tubes 14*b* (direction indicated by arrow 106), and exits at the first end 20 (direction indicated by arrow 108). A cross-flow of air or another, second fluid flowing across the tubes 14 (in the direction indicated by arrow 110), cools the gas so that the temperature of the hot gas is reduced in the heat exchanger 12, and the temperature of the air is increased. The intermediate portions of the tubes 14 can be exposed to the ambient environment to be cooled by a flow of ambient air across the tubes 14, as shown in FIG. 1. Alternatively, in other embodiments, the intermediate portions of the tubes 14 can be housed in a shell or other structure through which the second fluid flows. It is also appreciated that, in some embodiments, the fluid flowing through the tubes 14 can be hotter than the second fluid across the outside of the tubes 14, such that the direction of thermal transfer is reversed.

Only one of the apparatuses 10 of the system of FIG. 1 is shown in FIG. 2, but it is appreciated that the two apparatus of FIG. 1 can be similar or the same. As illustrated, each apparatus 10 includes an enclosure 32 that is configured to receive at least a portion of the heat exchanger 12. In particular, each enclosure 32 can receive the first or second end 20, 22 of the heat exchanger 12 so that the respective header 24*a*, 24*b* is at least partially disposed in an interior space 34 defined by the enclosure 32. In the event of a leak or other release of gas from one of the headers 24*a*, 24*b*, such leaked gas is received in the enclosure 32 of the respective apparatus 10 that houses that header 24*a*, 24*b*. The interior space 34 can be a confined space that is sealed by the apparatus 10. For example, the enclosure 32 can correspond in shape and size to one of the ends 20, 22 of the heat exchanger 12 and can cooperate with the heat exchanger 12 so that an end of one of the headers 24*a*, 24*b* is confined within the enclosure 32 of the respective apparatus 10.

In some cases, each header 24*a*, 24*b* can define a threaded connection of components that provide selective access to the interior of the header 24*a*, 24*b* and, hence, the ends of the tubes 14. For example, each header 24*a*, 24*b* can define a plurality of threaded holes, and each hole can be sealed by a threaded plug 36 or other member that is screwed into and tightened in the hole.

As shown in FIG. 2, a gas source 40 is configured to deliver an inert gas to the interior space 34 via an inlet 42. The gas source 40 can be a tank, bottle, or other pressure vessel that contains a pressurized volume of the inert gas. For example, the source 40 can be configured to provide a supply of nitrogen, argon, carbon dioxide, or other gases or mixtures of gases that can be used to dilute any leaked gas from the heat exchanger 12, such as inert, non-toxic, non-flammable, environmentally friendly gases. The source 40 can be fluidly connected to the enclosure 32 by a tubular member 44 such as a pipe or hose, which can include appropriate connectors at each end. The gas source 40 can deliver the gas to the interior space 34 of the enclosure 32 at a pressure that is higher than the ambient pressure of the environment outside the gas source 40 and the enclosure 32. For example, if the heat exchanger 12 is operating in an environment of standard atmospheric conditions, i.e., an absolute pressure of about 14.7 psi, the gas source 40 can be configured to provide the inert gas at an absolute pressure higher than 14.7 psi, such as about 14.7-100 psi. In a typical embodiment, the gas source 40 can be charged to a relatively high pressure, such as above 100 psi (e.g., 1000 psi or more), and the gas source 40 can be configured to provide the inert gas to the enclosure 32 to maintain a pressure within the enclosure 32 that is slightly above the ambient pressure, such as a pressure that is between about 0.01 and 10 psi above the ambient pressure, e.g., about 0.1-1 psi above the ambient pressure.

The enclosure 32 is adapted to maintain a positive pressure difference between the interior space 34 and the environment 46 outside the enclosure 32, i.e., so that the pressure inside the enclosure 32 is greater than the ambient pressure of the surrounding environment 46. Typically, the pressure within the enclosure 32 is maintained lower than the pressure of the fluid in the tubes 14 of the heat exchanger 12. Thus, in the event of a leak from the heat exchanger 12 in the enclosure 32, fluid will tend to flow from the heat exchanger 12 to the enclosure 32 and mix with the inert gas in the enclosure 32 provided from the gas source 40, thereby being diluted by the inert gas.

A regulator 48 can be configured to regulate the flow rate and/or the pressure of the gas provided from the source 40 to the interior space 34 of the enclosure 32. The regulator 48 can be configured to maintain the positive pressure difference in the enclosure 32, i.e., so that the pressure in the enclosure 32 is greater than the pressure outside the enclosure 32.

The enclosure 32 can also be configured to discharge inert gas from the interior space 34 to the outside of the enclosure 32 while maintaining the positive pressure difference. For example, the enclosure 32 can define an outlet 50 from which gas from the enclosure 32 can be discharged or vented. The outlet 50 can be a discrete port, as shown in FIG. 2, which can be a fixed or variable aperture, such as a valve. As inert gas flows into the enclosure 32 from the source 40 and exits the enclosure 32 from the outlet 50, the interior space 34 is swept by the inert gas. In other words, the inert gas mixes with any gas leaked from the heat exchanger 12, dilutes the leaked gas, and flushes the diluted, leaked gas from the interior space 34.

In some cases, the outlet 50 can be adjusted according to the pressure in the enclosure 32 or the pressure difference that exists between the enclosure 32 and the environment 46 around the enclosure 32. For example, the outlet 50 can include a pressure relief device 52, such as a relief valve, that automatically opens (or increases the opening of) the outlet 50 when the pressure in the enclosure 32 rises. Thus, the outlet 50 can be configured to automatically and continuously release gas from the interior space 34 of the enclosure 32 to prevent the pressure in the enclosure 32 from exceeding a predetermined maximum pressure regardless of the pressure of the incoming gas from the gas source 40 and any leaked fluid from the heat exchanger 12. In some cases, the outlet 50 can be configured to stay closed unless the pressure in the enclosure 32 is detected to exceed a predetermined pressure.

The apparatus 10 can include various other detectors for monitoring the content and/or operation of the apparatus 10. For example, as shown in FIG. 2, a flammable gas detector 60, a gas type detector 62, a temperature detector 64, and a pressure detector 66 can monitor the gas in the enclosure 32 and/or gas exiting the enclosure 32 through the outlet 50. The flammable gas detector 60 can be configured to detect the presence of a flammable gas, e.g., in cases where the heat exchanger 12 is used to cool or heat flammable gases. The gas type detector 62 can be configured to detect the type(s) of gas, e.g., to detect if a hazardous gas is being leaked from the heat exchanger 12 and discharged from the enclosure 32. The temperature detector 64 can detect temperatures above or below predetermined thresholds and/or variations in temperature, which may be indicative of a leak from the heat exchanger 12. Similarly, the pressure detector 66 can detect pressures above or below predetermined thresholds and/or variations in pressure, which may be indicative of a leak from the heat exchanger 12 or a problem with the gas source 40 or other component of the apparatus 10. Each of the detectors 60, 62, 64, 66 can be configured to communicate data to another device, alert an operator upon predetermined conditions, or automatically adjust an operation of the apparatus 10 and/or heat exchanger 12 according to the measured conditions.

The size and configuration of the enclosure 32 can be designed according to the heat exchanger 12, and the enclosure 32 can be provided as an integral component of the heat exchanger 12 or separate device that can be attached to the heat exchanger 12, e.g., as a retrofit. In one embodiment, shown in FIG. 4, the enclosure 32 includes a rectangular side or flange 70 that extends from a first end 72 to a second end 74. The first end 72 defines a rectangular aperture 76 that corresponds to the first end 20 of the heat exchanger 12 so that the enclosure 32 can receive the first end 20 of the heat exchanger 12 partially therein. At the first end 72, the enclosure 32 extends continuously around the perimeter of the heat exchanger 12 and can be joined to the outer surface of the heat exchanger 12, e.g., by a weld, adhesive, mechanical seal, or the like, so that a hermetic seal is formed with the heat exchanger 12. The second end 74 of the enclosure 32 defines an outwardly extending flange 78 and is closed by a flat, rectangular, sheet-like access panel 80 connected to the flange 78. The side 70 and access panel 80 of the enclosure 32, in combination with the heat exchanger 12, can together define and seal the interior space 34 so that gas generally only enters the interior space 34 from either the gas source 40 or a leak from the heat exchanger 12, and gas generally only exits the interior space 34 via the outlet 50.

FIG. 5 illustrates the plugs 36 on the header 24, as seen from the left side of FIG. 2 with the panel 80 of the apparatus 10 removed. As shown, each plug 36 can be a conventional threaded bolt that is secured in a correspondingly threaded hole in the header 24. The heat exchanger 12 can define a plurality of the plugs 36, and each plug 36 can correspond in location to one of the tubes 14 so that each tube 14 can be accessed by removing the corresponding plug 36.

In other embodiments, the apparatus 10 can correspond to other heat exchangers of different size and configurations. For example, as shown in FIG. 6, the side or flange 70 of the enclosure 32 is circular. The first end 72 defines a circular aperture 76 that corresponds to one of the ends 20, 22 of the heat exchanger 12 so that the enclosure 32 can receive the end 20, 22 of the heat exchanger 12 partially therein. As described above in connection with FIG. 4, the enclosure 32 extends continuously around the perimeter of the heat exchanger 12 and can be joined to the outer surface of the heat exchanger 12, e.g., by a weld, adhesive, mechanical seal, or the like, so that a hermetic seal is formed with the heat exchanger 12. The second end 74 of the enclosure 32 can be closed by a flat, circular, sheet-like access panel 80 that is connected to the round flange 78.

As illustrated in FIG. 7, the access panel 80 can be removably connected to the cylindrical side 70, e.g., by bolts 82 or other fasteners that connect to the flange 78, so that the access panel 80 can be removed from the side 70 to allow access to the interior space 34 of the enclosure 32 and the end 20, 22 of the heat exchanger 12 disposed within the space 34. In some cases, the access panel 80 can be hinged to the flange 78 and a latch or other releasable fasteners can be used to secure the panel 80 in its closed position. The interior space 34 can otherwise be hermetically sealed, or substantially hermetically sealed.

The apparatus 10 can be used with a heat exchanger 12 that handles any type of fluid. In some cases, one or both of the fluids flowing through the heat exchanger 12 are fluids that are desired to be either contained or not leaked in concentrated form. For example, the heat exchanger 12 can transfer heat to or from a flammable fluid, such as hydrogen gas, and in some cases the flammable fluid can have a potential to auto-ignite if leaked in concentrated form. Similarly, the heat exchanger 12 can receive fluids that could be hazardous to personnel, such as hydrogen sulfide gas, isocyanate gas, and the like, or fluids that could pose a risk of environmental damage.

The output from the enclosure 32 can be output to a vent system or stack. Depending on the nature of the application and the fluids being handled, gases output from the apparatuses 10 can be directed to a vent system or stack, which may be vented to the atmosphere or a processing device such as a burner or flare system. In cases where multiple of the apparatuses 10 are used in proximity to one another, the outputs can be connected and routed, e.g., via a header, to a vent system or stack. Further, in such cases where multiple apparatuses 10 are needed, some of the components of the apparatus 10 can be shared. For example, a single gas source 40 and/or regulator 48 can provide gas to the multiple enclosures 32, a single pressure relief device 52 can be connected to the multiple enclosures 32, and/or single detectors 60, 62, 64, 66 can be used to monitor the gases output from the multiple enclosures 32.

Many modifications and other embodiments of the inventions set forth herein will come to mind to one skilled in the art to which these inventions pertain having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An apparatus for purging gases released from a heat exchanger, the apparatus comprising:

an enclosure configured to receive at least a portion of the heat exchanger, the enclosure defining an interior space wherein the enclosure comprises at least one side defining an aperture for receiving an end of the heat exchanger and forming a hermetic seal with the heat exchanger such that the enclosure and the heat exchanger together define and seal the interior space;

a gas source configured to deliver an inert gas to the interior space of the enclosure at a pressure higher than an ambient pressure outside the gas source and the enclosure, the enclosure being adapted to maintain a positive pressure difference between the interior space and the ambient pressure;

a detector configured to detect a leak of a gas from the heat exchanger into the interior space of the enclosure;

a pressure relief device configured to release gas from the interior space of the enclosure if the pressure in the interior space exceeds a predetermined level; and a heat exchanger configured to receive a flow of a first gas and a flow of a second gas and transfer thermal energy between the first and second gas, the heat exchanger including a plurality of tubes for receiving the flow of the first gas and a header for connecting ends of the tubes, the header being located at least partially in the interior space of the enclosure such that gas leaked from the header is received in the enclosure and diluted by the inert gas therein.

2. An apparatus according to claim 1 wherein the header defines a threaded connection of components for sealing the header.

3. An apparatus according to claim 1 wherein the enclosure comprises a first side that extends continuously around a perimeter of the heat exchanger and an access panel, the access panel being removably connected to the first side by one or more fasteners such that the access panel can be removed from the side to allow access to the heat exchanger within the interior space.

4. An apparatus according to claim 1, further comprising a regulator configured to regulate at least one of a flow rate and a pressure of the inert gas provided from the gas source to the interior space of the enclosure to maintain the positive pressure difference.

5. An apparatus according to claim 1 wherein the gas source is a tank of nitrogen gas.

6. An apparatus according to claim 1 wherein the enclosure is configured to discharge inert gas from the interior space to the outside of the enclosure while maintaining the positive pressure difference such that the interior space is swept by the inert gas.

7. A method of purging gases released from a heat exchanger, the method comprising:

providing an enclosure that defines an interior space and receives at least a portion of the heat exchanger in the interior space;

delivering a flow of inert gas to the interior space of the enclosure at a pressure higher than an ambient pressure outside the enclosure and maintain a positive pressure difference between the interior space and the ambient pressure;

detecting a leak of a gas from the heat exchanger into the interior space of the enclosure;

releasing gas from the interior space of the enclosure when the pressure in the interior space exceeds a predetermined level; and receiving a flow of a first gas through a plurality of tubes connected by a header of the heat exchanger and receiving a flow of a second gas in the heat exchanger and transferring thermal energy between the first and second gas, wherein detecting a leak of the gas comprises detecting the first gas leaked from the heat exchanger into the interior space of the enclosure, and wherein delivering the flow of inert gas to the interior space comprises diluting the first gas leaked from the heat exchanger with the inert gas in the enclosure.

8. A method according to claim 7 further comprising providing a threaded connection between the header and a plurality of tubes, the threaded connection being disposed in the enclosure.

9. A method according to claim 7 wherein providing the enclosure comprises providing at least one side defining an aperture for receiving an end of the heat exchanger and forming a hermetic seal with the heat exchanger such that the enclosure and the heat exchanger together define and seal the interior space.

10. A method according to claim 9 wherein providing the enclosure comprises providing a first side that extends continuously around a perimeter of the heat exchanger and an access panel, the access panel being removably connected to the first side by one or more fasteners such that the access panel can be removed from the side to allow access to the heat exchanger within the interior space.

11. A method according to claim 7, further comprising regulating at least one of a flow rate and a pressure of the inert gas delivered to the interior space of the enclosure to maintain the positive pressure difference.

12. A method according to claim 7 wherein delivering the flow of inert gas to the enclosure comprises delivering nitrogen gas.

13. A method according to claim 7, further comprising discharging inert gas from the interior space to the outside of the enclosure while maintaining the positive pressure difference such that the interior space is swept by the inert gas.

* * * * *